US005116682A

United States Patent [19]

Chakravarti et al.

[11] Patent Number: 5,116,682

[45] Date of Patent: May 26, 1992

[54] PROCESS FOR PRODUCING ANTI-WICKING POLYESTER YARN AND PRODUCT PRODUCED THEREBY

[75] Inventors: Kalidas Chakravarti; Jamshiid Khalatbari, both of Midlothian, Va.

[73] Assignee: Bridgestone/Firestone, Inc., Akron, Ohio

[21] Appl. No.: 628,764

[22] Filed: Dec. 17, 1990

[51] Int. Cl.[5] ..... B05D 3/02; B32B 27/36

[52] U.S. Cl. ..... 428/395; 57/258; 219/10.61 R; 427/45.1; 427/393.4; 428/422

[58] Field of Search ..... 427/45.1, 389.9, 393.4, 427/394; 34/1; 219/10.61 R, 10.61, 10.75; 428/288, 375, 378, 395, 421, 422; 57/258

[56] References Cited

U.S. PATENT DOCUMENTS

| | | | |
|---|---|---|---|
| 2,226,871 | 12/1940 | Nicholas | 219/10.61 |
| 2,405,037 | 7/1946 | Hsu | 219/10.61 |
| 2,433,842 | 1/1948 | Griffin | 34/1 |
| 2,492,187 | 12/1949 | Rusca | 219/10.61 |
| 2,542,301 | 2/1951 | Barrington | 264/26 |
| 2,865,790 | 12/1958 | Baer | 427/45.1 |
| 3,205,334 | 9/1965 | Manwaring | 219/10.61 |
| 3,578,487 | 5/1971 | Knell et al. | 427/393.4 |
| 4,564,561 | 1/1986 | Lore et al. | 427/393.4 |
| 4,612,356 | 9/1986 | Falk | 427/393.4 |

FOREIGN PATENT DOCUMENTS

| | | | |
|---|---|---|---|
| 2120913 | 9/1972 | Fed. Rep. of Germany | 427/393.4 |
| 55-148281 | 11/1980 | Japan | 427/393.4 |
| 57-106776 | 7/1982 | Japan | 427/393.4 |
| 58-13778 | 1/1983 | Japan | 427/393.4 |
| 58-36271 | 3/1983 | Japan | 427/393.4 |
| 58-149385 | 9/1983 | Japan | 427/393.4 |
| 59-30919 | 2/1984 | Japan | 427/393.4 |
| 61-138775 | 6/1986 | Japan | 427/393.4 |
| 62-141173 | 6/1987 | Japan | 427/393.4 |

*Primary Examiner*—Michael Lusignan
*Assistant Examiner*—Terry J. Owens
*Attorney, Agent, or Firm*—Daniel N. Hall

[57] ABSTRACT

A process for producing anti-wicking and water repellant polyester yarns at high processing speeds. Polyester yarn or other heat stable yarn is continuously fed to a coating station, the yarn is then coated with a fluorocarbon polymer emulsion or dispersion and the yarn is dried in an RF oven, heat cured in a coating oven, and then wound.

18 Claims, 1 Drawing Sheet

PROCESS FOR PRODUCING ANTI-WICKING POLYESTER YARN AND PRODUCT PRODUCED THEREBY

FIELD OF THE INVENTION

Water repellency and anti-wicking properties are desirable in many applications of heat stable yarn such as polyester fibers and fabrics. Polyester fibers with anti-wicking properties allow fabric manufacturers to process the fibers and use various loom sizes for fabric preparation without costly and tedious water repellent or anti-wicking treatments in these plants. The present invention relates to a process for producing anti-wick heat stable fibers at a cost effective high processing speed.

BACKGROUND

Although anti-wick heat stable fabrics such as polyester fabrics are commercially available, the anti-wicking fabric treatments are tedious and the technology is not available to most of the fabric manufacturers. Post-treatment of fabric with anti-wicking treatment tends to result in uneven and less durable coatings. Therefore, it is desirable to have the anti-wicking yarn prepared first and available to the fabric manufacturers for direct weaving into fabric.

Anti-wicking property refers to the ability of a fiber or a fabric to resist wicking water or moisture into the fiber bundles, thus preventing mildew growth and discoloration or weakening of the coated fibers. Anti-wicking is a surface tension phenomenon resulting from the fiber's tendency to transport water through capillary action. In addition, it is desirable that anti-wicking properties of the fibers be durable, so that the anti-wicking properties will not be lost by repeated contact with moisture or water.

A method for manufacturing a continuous filament is known to the art and disclosed in U.S. Pat. No. 2,542,301 issued to Barrington. The '301 patent discloses the production of continuous filaments from solution or suspensions of cellulose derivatives.

U.S. Pat. No. 2,865,790 issued to Baer relates to the impregnation and bonding of fibrous materials in order to improve the tensile strength of the finished products. The '790 patent discloses treatment of a fibrous material with a radio frequency (RF) field at right angles to the length of said material.

SUMMARY OF THE INVENTION

Figure 1:
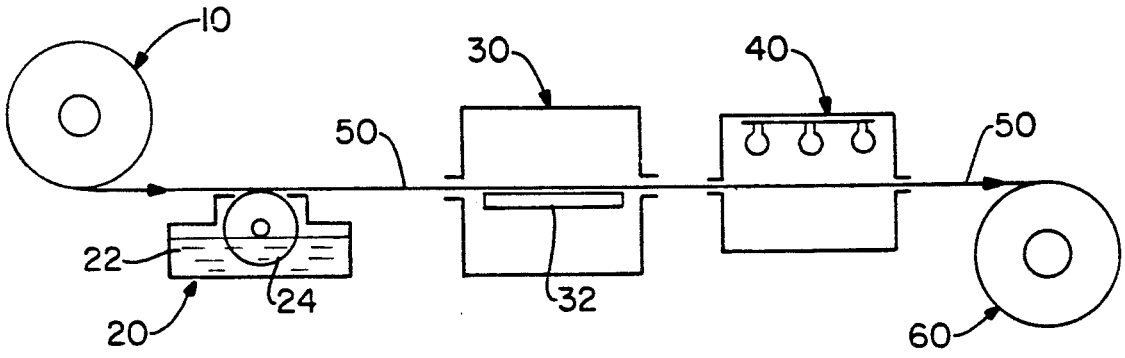
FIG. 1 is a schematic drawing showing the various steps or stations of treating and drying a heat stable yarn according to the present invention.

The current invention relates to a method for applying a coating of a water repellent, anti-wicking, water shedding agent to heat stable yarn such as polyester at processing speeds of greater than 1000 feet per minute (FPM) and often from about 1,100 to about 3,000 FPM. The agent is generally an aqueous polyfluorinated polymer emulsion or dispersion.

After the polyfluorinated agent is applied to the yarn, the yarn is dried using an RF or induction dryer to remove most of the water. The use of this dryer allows rapid drying of the yarn before it contacts any guide surfaces, allowing the coating to become non-transferable to any guide surfaces. The yarn coating is then cured in an electrical contact heater or in a non-contact infrared oven @]200° C. to 260° C. for a short duration to bond the polyfluorinated agent onto the fiber surface.

It is therefore an object of the current invention, to develop an anti-wicking, water repellent durable pretreatment for coating of polyester yarn.

A further objective of this invention is to provide anti-wicking yarn at processing speeds greater than 1000 FPM of coated yarn production.

DETAILED DESCRIPTION OF THE INVENTION

The substrate of the current invention is generally a heat stable yarn such as a polyester yarn. However, other types of heat stable yarn such as glass, nylons, aramids, etc. can be used in anti-wick yarn preparation.

A polyester fiber is generally any long chain polymer composed of at least 75 percent by weight of an ester and an acid. Such polyesters are formed by the reaction of a glycol containing from about 2 to about 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'-dibenzoio acid, or 2,8-di-benzofuran-dicarboxylic acid. Examples of linear terephthalate polyesters which may be employed include poly(ethylene terephthalate) PET, poly (butylene terephthalate), poly(ethylene terephthalate/5-chloroisophthalate), poly(ethylene terephthalate/5-sodiumsulfoisophthalate), poly(cyclohexane-1,4-dimethylene terephthalate), and poly(cyclohexane-1,4-dimethylene terephthalate/hexahydroterephthlate), with PET being preferred. Ester-forming ingredients which may be copolymerized with the acid component may include glycols such as diethylene glycol, trimethylene glycol, tetramethylene glycol, hexamethylene and the like. Typically, the yarn is spun with a spin finish known to the art and to the literature, as long as it is compatible with the ionic nature of the coating. The preferred spin finish is composed mainly of a nonionic polyether. Other spin finished compositions that may be utilized include fatty acid esters, lubricants, mineral oil, and waxes. The amount of the spin finish is generally from about 0.4 percent to about 1.0 percent and preferably from about 0.4 to about 0.8 percent by weight based upon total weight of the yarn.

The specific yarn denier, a measure of fineness, can vary vastly and depends upon the final application, such as from about 500 to about 2000 denier, with about 800 to 1,200, e.g., 1000 denier being a desired value for a specific application. The number of filaments ranges from about 70 filaments to about 336 filaments, desirably 70 to about 232 filaments, and preferably 192 to about 232 filaments. As noted, any heat stable yarn or fiber known to the art and the industry may be used, but preferably the yarn has low thermal shrinkage. For polyester fiber, a free thermal shrinkage of less than about 4 percent at approximately 177° C. is desirable, and less than about 3.5 is preferred.

Referring to FIG. 1, the substrate feeder yarn 10 is fed continuously into a coater 20 containing a solution of a fluorocarbon coating material 22 and a roller 24. This coating material is generally an aqueous emulsion or dispersion, that can be anionic, cationic, or nonanionic in nature. Generally, the ionic nature of the fluorocarbon emulsion is selected based on ionic nature of the spin finish used on the fiber. Specifically, the coating emulsions are desirably polyfluorinated polymers, with fluorine making up about 5 to about 52 percent by weight, and desirably from about 7 to about 10 percent of weight of the total polymer weight. The active fluorinated polymer in the aqueous emulsion generally exists in an amount of from about 2 to about 20 percent by weight of the emulsion. The amount of dry pick-up of the polyfluorinated material is generally from about 0.1 weight percent to about 1.0 weight percent and desirably from about 0.3 to about 0.8 weight percent based upon the total weight of yarn. Such polymers are known to the art and to the literature. Examples of such polyfluorinated material include various perfluoronated compounds such as (n-alkyl perfluoroalkane sulfonamido) acrylate and perfluoroalkyl acrylic or methacrylic copolymer wherein the alkyl group is generally from 4 to 10 carbon atoms. A host of perfluorinated materials are commercially available under such tradenames as FX-13, FX-14, FX-367, FX-398, and FX-399 (3M Company), ASAHIGUARD AG-710 (Asahi Chemical Company), MILLIGUARD 309 or 345 (Millikin Company) or ZONYL-6700 (DuPont Company). The emulsions or dispersions generally contain surfactants or emulsifiers in amounts of about 1 to about 10 percent by weight of the emulsion, preferably from about 1 to about 3 percent in order to emulsify the polyfluorinated material. The remaining amount, that is, from about 70 percent to about 97 percent by weight of the emulsion is water.

Other additives that can be utilized in the coating material include drying agents and antibacterial agents. These materials are generally known to the art and literature and can include additional processing aids.

The drying or removing of water from the fiber surface is an important feature of the present invention. Immediately after coating the heat stable yarn with the fluorinated polymer coating, it is dried in a fast drying radio-frequency (RF) oven 30 (also known as an induction heat oven). The RF dryer works very much like a microwave oven in which a heating element, generally a set of electrodes 32 creates high-frequency vibrational motion of water molecules which thereby selectively heat and evaporate water from the fiber surface. Therefore, in this process only the water is removed from the coated yarn, but the polyester is subject to only slight heat. The yarn does not touch, or come into contact with the electrodes, i.e., is contact free with any oven heating or drying element, hence, no transfer of finish to the electrode results. This results in rapid drying, with little or no loss in fiber tensile properties, hence, no fiber burnout occurs.

The RF oven of the current invention generally operates at approximately 10 to about 30 kw output capacity, preferably from about 10 to about 20 kw. The coated material is subject to heat in the RF oven generally for about 0.1 to about 1.0 seconds and preferably from about 0.2 to about 0.6 seconds total resistence time. The temperature of the RF oven reaches about 140° C. to about 160° C. and desirably from about 120° C. to about 150° C. The amount of water removed during the non-contact drying step is generally at least 90 percent, desirably at least 95 percent; more desirably at least 98 percent, and preferably at least 99 percent by weight of the total water in the coating material.

Subsequent to drying in the RF oven, the dried yarn coating is then heat cured at from about 200° C. to about 260° C., desirably from about 220° C. to about 260° C., and preferably from about 240° C. to about 260° C. The yarn is heat cured for about 0.1 to 0.5 seconds, desirably from about 0.1 to about 0.4 seconds, and preferably from about 0.1 seconds to about 0.2 seconds. This heat curing takes place in an oven 40 which can be an electrical contact heater or an infrared heating oven, thus curing or setting the fluoropolymer coatings to the fiber surfaces. That is, the coating is actually bonded to the fibers. The heating also removes some of the surfactants from the coating remaining on the fiber surfaces, thus making it a better anti-wicking product.

In another embodiment of the invention, either of the above mentioned curing ovens can exist as multiple ovens connected in series, e.g., two ovens.

The yarn path 50 is desirably maintained at a short distance from the electrodes of the RF ovens to achieve efficient drying of the coatings and avoid fiber burnout. This distance is generally from about 2 mm to about 25 mm, and preferably from about 3 mm to about 10 mm.

It is desirable for the coatings of the fluorocarbon polymer to be uniform over the fiber surface. The drying and heat curing must be sufficient to make the yarn hydrophobic so that the water contact angle is generally greater than about 90°, and preferably between 95° and 120°. A water contact angle greater than 90° makes a surface non-wettable and hence imparts better anti-wicking properties.

After passing through the contact or IR oven 40, the yarn is wound on a series of winders 60 or on a beamer. These winders are generally package winders, and the yarn "string-up" is done using an aspirator gun to achieve more efficient winding, although any winding method known to the art and the literature can be used.

The rapidly dried anti-wicking fibers of the current invention can be utilized in the manufacture of various industrial fabrics where permanent water repellency properties are desired such as boat covers, tents, roof materials, awnings and the like.

EXAMPLE 1

Figure 2:
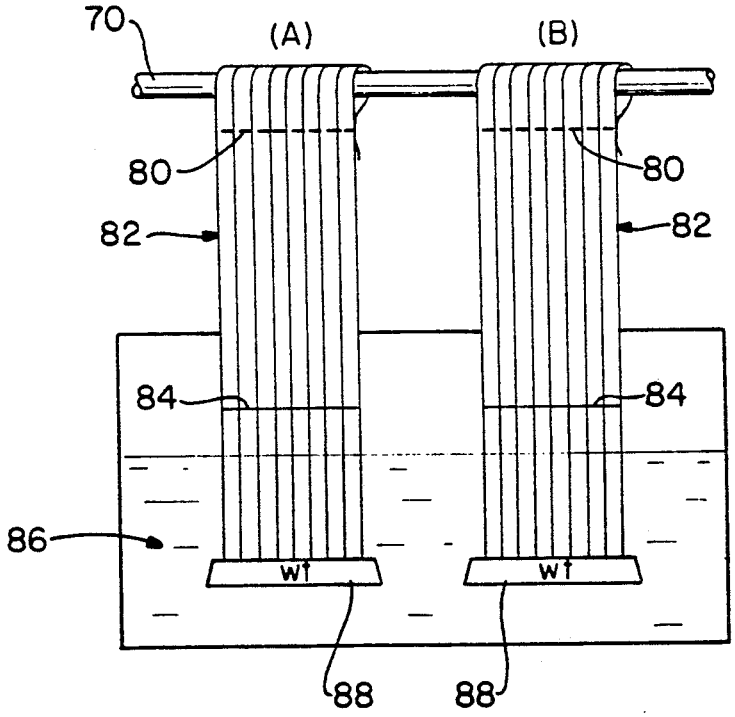
FIG. 2 is a schematic drawing showing the comparative test method utilized for determination of the wicking properties.

Low shrinkage 1000 denier polyethylene terephthalate yarn was prepared in which free shrinkage @ 177° C. was below 4.0 percent and generally below 3.0 percent. The yarn was overcoated with an aqueous emulsion containing about 4.0 percent active fluorinated polymer. The emulsion contained ethoxylated alcohol as surfactant and a small amount of antibacterial agent. The material was received from 3M Company, and is basically an anionic emulsion with 7.2 percent fluorine (FX-398). The emulsion was diluted with distilled water before the application to reduce the percent pick-up of the material on yarn (for cost reduction purposes). The calculated amount of dry pick-up was about 0.4 percent of the perfluorinated material by weight of the yarn. The yarn was immediately dried via a non-contact RF dryer (Macrowave TM, Radio Frequency Company) as described hereinabove in this invention having a 20 kw capacity with a residence time in the RF-drier of about 0.4 sec. The operating frequency of the RF was 40.68 megahertz. The coated dried yarn was cured at an elevated temperature of about 240° C. using a contact heater where surface temperature of the heater was not allowed to rise above 260° C. The residence time for curing was about 0.2 sec. After the drying and curing process, the yarn was wound on a package winder. The yarn was then tested for wicking properties in water containing about 0.5 percent Liquitin blue, from Milliken Company. The fiber (82), marked at a 2 inch water level reference point (84), was hung vertically from horizontal bar (70) through the use of staple 80 with about a 0.6 gm weight (88) at the bottom, and dipped into the dye solution (86) and allowed to stand for about two hours. See FIG. 2. After this period the fiber was carefully removed and the water blotted and the dye wicking mark was read on the yarn. The wicking tests showed very low wicking on this yarn, i.e., about ¼" to ½": In comparison, the control 1000 denier fiber without the treatment as described hereinabove showed very high wicking, about 5½" to 6". The yarn with the fluorocarbon emulsion coatings, but without the drying and curing process as described in this invention showed about 2"-2¼" wicking. The yarn produced as described in this invention with fluoropolymer polymer coatings, utilizing the drying and curing process, did not significantly change the fiber physical retention properties such as strength, elongation and shrinkage. See Table I which shows the anti-wicking treatment did not significantly alter pertinent physical yarn properties.

TABLE I

| | Yarn Properties Prior to Anti-Wick Treatment | Yarn Properties After Anti-Wick Treatment |
|---|---|---|
| Denier (gm/9000 m) | 1003 | 1005 |
| Breaking Strength (kg.) | 7.64 | 7.63 |
| Elongation at Break (%) | 18.9 | 19.0 |
| Elongation at 4.54 kg (%) | 12.3 | 12.3 |
| Hot Air Shrinkages (%) (Free at 177° C.) | 3.4 | 3.2 |
| Hot Air Shrinkage (%) (0.05 gpd Load at 177° C.) | 1.4 | 1.7 |

An additional observed advantage was that the treated yarn showed very high water contact angle (approximately 100°). This high contact angle demonstrates the non-wetting properties of the fiber with water. It is also important to note that repeated water washings did not change the non-wetting properties of the fibers, indicating the permanence of the coatings by this process.

EXAMPLE 2

Low shrinkage 1000 denier polyester yarn was prepared with free shrinkage @ 177° C. below 3.0 percent, and containing a polyether based spin finish composition with finish on yarn level of about 0.4 percent by weight. The yarn was overcoated with a dilute solution of MILLIGUARD 345 from Milliken Chemical so that percent solids (dry pick-up weight) of the material Milliguard 345 is about 0.5 percent by weight of the yarn. Following the overcoat application the yarn was dried and cured using the same procedure as described in Example 1. The yarn prepared showed excellent non-wicking properties. The wicking experiments were made as described in the Example 1. The results of wicking tests showed about ¼" to ½" wicking. Water contact angle on filaments was found to be about 95°, whereas the control yarn with spin finish only and without any treatment showed about 30° contact angle. The contact angles were estimated from wetting force measurements of the fibers in water using Wilhelmy-type Electro-balance.

EXAMPLE 3

Low shrinkage polyester yarn (1000 denier) was made in the same way as described in the Example 2, and the yarn was treated with a coating composition containing MILLIGUARD 309 from a dilute water emulsion. The percent solids pick-up of the perfluorinated polymer was about 0.30 percent. After the yarn was treated by the method as described in this invention, the wicking test results indicated about ¼" to ½" wicking, which is considered excellent anti-wicking properties. The water contact angle for the yarn was about 100°.

EXAMPLE 4

Low shrinkage 1000 denier polyester yarn was made in the same way as described in Example 2. The yarn was treated with a fluorocarbon composition from 3M Company—FX-399 an anionic fluorochemical emulsion containing 7.2 percent flourine content in water to have percent solid pick-up on yarn in the range of 0.3 to 0.6 percent by weight. Following the treatment, yarn was dried and cured by the process as described above. The wicking test result for this yarn showed less than ½", which is considered as excellent anti-wicking property. Water contact angle of the yarn after treatment was about 97°.

EXAMPLE 5

1000 Denier polyester yarn in which free shrinkage @ 177° C. was about 12 percent and was prepared via spin-drawing. The fiber was spun with a finish composition containing trimethylol propane tripellargonate, sorbitan monooleate, and 1-ethyl-2(heptadecenyl) 1,2-hydroxyethyl-2-imidozolinium ethyl sulfate. The spin finish or yarn was about 0.8 percent level. The yarn was overcoated with a fluorocarbon composition containing FX-367 a cationic fluorochemical emulsion containing 7.3 percent fluorine content from 3M company at about 0.5 percent on yarn and dried and cured as described in the invention. The wicking test result for this yarn showed less than about ½", which is considered very good non- wicking properties. The water contact angle was about 96°, indicating non-wetting properties of the yarn.

While in accordance with the Patent Statutes, the best mode and preferred embodiment has been set forth, the scope of the invention is not limited thereto, but rather by the scope of the attached claims.

What is claimed is:

1. A process for improving the anti-wicking of polyester yarn, comprising the steps of:

(a) applying a coating to the yarn of an aqueous emulsion or dispersion of a heat-curable polyfluorinated polymeric anti-wicking agent;

(b) processing said yarn at a speed of at least about 1000 FPM through a dryer to remove at least 90 percent of the water in the coating, said processing being carried out without the coating contacting any surface to avoid transfer of the finish;

(c) curing said coating by heating said yarn at about 200°-260° C. for about 0.1-0.5 seconds so as to bond the anti-wicking agent to the yarn surface; and (d) collecting said yarn carrying said cured coating of anti-wicking agent.

2. The process of claim 1, wherein said dryer in (b) is at least one radio-frequency (RF) oven.

3. The process of claim 2, wherein said curing in (c) is carried out by passing said yarn through an electrical contact heater or infra-red heating oven.

4. The process of claim 2, wherein said yarn is passed through said RF oven with a residence time of about 0.2-1.0 seconds.

5. The process of claim 2, wherein said aqueous emulsion or dispersion comprises (by weight):

(a) 2 to 20 percent of said polyfluorinated polymeric anti-wicking agent;

(b) 96 to 70 percent water; and (c) 2 to 10 percent surfactants or emulsifiers.

6. The process of claim 5, wherein said polyfluorinated polymeric anti-wicking agent contains about 7 to 52 percent by weight fluorine.

7. The process of claim 6, wherein said polyfluorinated polymeric anti-wicking agent comprises at least one (n-alkyl perfluoroalkane sulfonamido) acrylate or a perfluoroalkyl acrylic or methacrylic copolymer wherein said alkyl group contains from 4 to 10 carbon atoms.

8. The process of claim 2, wherein said yarn is polyethylene terephthalate (PET) yarn of about 1000 denier.

9. The process of claim 1, wherein said processing removes at least 95 percent of said water.

10. The process of claim 3, wherein said processing removes at least 98 percent of said water.

11. The process of claim 5, wherein said processing removes at least 98 percent of said water.

12. The process of claim 7, wherein said processing removes at least 99 percent of said water.

13. An anti-wicking yarn prepared by the process of claim 1.

14. An anti-wicking yarn prepared by the process of claim 3.

15. An anti-wicking yarn prepared by the process of claim 5.

16. An anti-wicking yarn prepared by the process of claim 7.

17. An anti-wicking yarn prepared by the process of claim 9.

18. An anti-wicking yarn prepared by the process of claim 12.

* * * * *